US011602207B2

(12) United States Patent
Wong et al.

(10) Patent No.: US 11,602,207 B2
(45) Date of Patent: Mar. 14, 2023

(54) ANGLE DEFLECTION TYPE TWISTED HAIR STYLING DEVICE

(71) Applicant: Spectrum Brands, Inc., Middleton, WI (US)

(72) Inventors: Kin Man Wong, Dongguan (CN); Wing Han Wong, Dongguan (CN)

(73) Assignee: SPECTRUM BRANDS, INC., Middleton, WI (US)

( * ) Notice: Subject to any disclaimer, the term of this patent is extended or adjusted under 35 U.S.C. 154(b) by 73 days.

(21) Appl. No.: 16/504,180

(22) Filed: Jul. 5, 2019

(65) Prior Publication Data

US 2020/0205540 A1 Jul. 2, 2020

(30) Foreign Application Priority Data

Dec. 27, 2018 (CN) ..... 201811611231.0

(51) Int. Cl.
*A45D 1/12* (2006.01)
*A45D 1/04* (2006.01)
(Continued)

(52) U.S. Cl.
CPC ..... *A45D 1/04* (2013.01); *A45D 1/12* (2013.01); *A45D 2/001* (2013.01); *A45D 1/18* (2013.01); *A45D 2/002* (2013.01)

(58) Field of Classification Search
CPC ... A45D 1/28; A45D 1/02; A45D 1/18; A45D 1/14; A45D 1/10; A45D 1/08;
(Continued)

(56) References Cited

U.S. PATENT DOCUMENTS 6,070,596 A * 6/2000 Altamore ..... A45D 1/04 132/224
D901,770 S * 11/2020 Wang ..... D28/35
(Continued)

FOREIGN PATENT DOCUMENTS

CN 206137462 U 5/2017
CN 207023588 U 2/2018
(Continued)

OTHER PUBLICATIONS

Extended European Search Report for EP Patent Application 19903646.8 dated Sep. 1, 2022; 9 pp.
(Continued)

*Primary Examiner* — Nicholas D Lucchesi
*Assistant Examiner* — Jennifer Gill
(74) *Attorney, Agent, or Firm* — Armstrong Teasdale LLP

(57) ABSTRACT

Disclosed is an angle deflection type twisted hair styling device, including an upper gripping portion and a lower gripping portion openable and closeable through a hinge structure. An upper clamping head is connected to the upper gripping portion. A lower clamping head is connected to the lower gripping portion. An upper clamping surface is provided on the upper clamping head. A lower clamping surface is provided on the lower clamping head. The upper clamping surface has an upper twisted deflection angle with respect to the upper gripping portion. The lower clamping surface has a lower twisted deflection angle with respect to the lower gripping portion. The upper twisted deflection angle equal to the lower twisted deflection angle. A hairstyle with an inclined angle and a twisted shape can be realized without rotation of a user's hand, and the hairstyle can be completed without major changes to perm action.

17 Claims, 2 Drawing Sheets

(51) Int. Cl.
*A45D 2/00* (2006.01)
*A45D 1/18* (2006.01)

(58) Field of Classification Search
CPC .... A45D 2/002; A45D 7/02; A45D 2200/205; A45D 2/001; A45D 1/04; A45D 1/06; A45D 2/40; A45D 1/12; D06F 75/30
USPC ..... D28/35, 37
See application file for complete search history.

(56) References Cited

U.S. PATENT DOCUMENTS

| | | | | |
|---|---|---|---|---|
| 2005/0150511 | A1 | 7/2005 | Park | |
| 2011/0061672 | A1* | 3/2011 | Schmider | A45D 1/12 132/226 |
| 2011/0061673 | A1 | 3/2011 | Yahnker et al. | |
| 2014/0238432 | A1 | 8/2014 | Deng | |
| 2016/0213116 | A1* | 7/2016 | Williams | A45D 1/04 |
| 2016/0286928 | A1 | 10/2016 | Weatherly et al. | |
| 2016/0360846 | A1* | 12/2016 | Shami | A45D 1/04 |

FOREIGN PATENT DOCUMENTS

| | | | |
|---|---|---|---|
| EP | 0077600 | A2 | 4/1983 |
| KR | 20100001162 | U | 2/2010 |
| KR | 101311808 | B1 | 9/2013 |
| KR | 101564408 | B1 | 10/2015 |

OTHER PUBLICATIONS

International Search Report and Written Opinion for Patent Application PCT/US2019/068569 dated Mar. 12, 2020; 13 pp.

* cited by examiner

ANGLE DEFLECTION TYPE TWISTED HAIR STYLING DEVICE

FIELD OF THE DISCLOSURE

The invention relates to the technical field of styling devices, in particular to an angle deflection type twisted hair styling device.

BACKGROUND OF THE DISCLOSURE

A hair styling device, including a hair straightener, a hair curler and the like, is mainly used to design style of hairs. The existing hair straightener generally includes an upper gripping portion and a lower gripping portion, which are openable and closeable through a hinge structure, where an upper clamping head is connected to the upper gripping portion, a lower clamping head is connected to the lower gripping portion, an upper clamping surface is arranged on the upper clamping head, a lower clamping surface is arranged on the lower clamping head, and the upper clamping surface is arranged to be paired with the lower clamping surface and thus an clamping surface for hairs is formed. However, the upper clamping surface and the lower clamping surface are generally flat and straight clamping surface structures.

For example, a Chinese invention patent with authorized announcement No.: CN 206137462 U discloses an angle deflection type hair straightener, which includes an upper clamping plate and a lower clamping plate hinged to the upper clamping plate, where the upper clamping plate has an upper gripping portion and an upper clamping head connected to the upper gripping portion, and the upper clamping head has a twisted deflection angle $\alpha$ with respect to the upper gripping portion, the lower clamping plate has a lower gripping portion cooperating with the upper gripping portion, and the lower gripping portion is connected to a lower clamping head cooperating with the upper clamping head. The angle deflection type hair straightener further includes a printed circuit board (PCB) control plate arranged on the upper clamping plate or the lower clamping plate. When a user uses the hair straightener, the head of the user is better supported and thus can be prevented from being subjected to a lateral pulling force, and a better user experience is obtained. Further, the hair straightener adopts a structure design that is more in line with usage habits, and has advantages of convenient operation and labor saving. Though each of the upper clamping head and the lower clamping head has a twisted deflection angle with respect to a corresponding gripping portion, and thus a convenient user operation is achieved, heat generating plates of the upper clamping head and the lower clamping head are flat and straight, and hair styling effect is not essentially improved.

As another example, a Chinese invention patent with authorized announcement No.: CN 201806120 U discloses a novel electric heating hair iron, which belongs to the technical field of hair treatment devices. The novel electric heating hair iron includes a handle, an electric heater, a clamping arm and a clamping plate. The electric heater is arranged in the clamping arm, and the clamping plate is arranged at an inner side of the clamping arm. A surface of the clamping plate is fixed directly or mounted through a rail on the electric heater. Another surface of the clamping plate is wavy. Two clamping plates arranged on/below the clamping arm are engaged with each other. For the novel electric heating hair iron, compared with a structure of other clamping plate, the structure of the clamping plate of the novel of electric heating hair iron is change from a flat surface or V-shaped surface to a waved curved surface, and thus a variety of hairstyles can be achieved. Further, the clamping arm of the novel electric heating hair iron can adjust its angle, and thus is convenient to use. Though a clamping surface of the clamping plate is changed from a common flat surface or V-shaped surface to a waved curved surface of a same peak height, a styling effect for hairs is too regular, a standard wavy shape hairstyle makes hairs lack of layering, and it is required to constantly switch an angle of the electric heating iron, when the user wants to change a hairstyle, thereby causing a large hand movement and an inconvenient operation.

SUMMARY OF THE DISCLOSURE

The invention aims to provide an angle deflection type twisted hair styling device, for solving deficiencies of the above-mentioned prior art.

In order to solve above technical problems, the technical solution adopted in the invention is: an angle deflection type twisted hair styling device, including an upper gripping portion and a lower gripping portion, the upper gripping portion and the lower gripping portion are openable and closeable through a hinge structure, an upper clamping head is connected to the upper gripping portion, a lower clamping head is connected to the lower gripping portion, an upper clamping surface is provided on the upper clamping head, a lower clamping surface is provided on the lower clamping head, and the upper clamping surface is arranged to be paired with the lower clamping surface, in which, the upper clamping surface has an upper twisted deflection angle with respect to the upper gripping portion, and the lower clamping surface has a lower twisted deflection angle with respect to the lower gripping portion, the upper twisted deflection angle is equal to the lower twisted deflection angle.

In the above technical solution, the upper clamping head has the upper twisted deflection angle with respect to the upper gripping portion, and the lower clamping head has the lower twisted deflection angle with respect to the lower gripping portion.

In the above technical solution, the upper twisted deflection angle and the lower twisted deflection angle each are in a range of 60-120 degrees.

In the above technical solution, an upper heat insulating layer is provided between the upper clamping head and the upper clamping surface, and a lower heat insulating layer is provided between the lower clamping head and the lower clamping surface.

In the above technical solution, upper side teeth are arranged at an outer edge of the upper clamping surface, and lower side teeth are arranged at an outer edge of the lower clamping surface.

In the above technical solution, an auxiliary gripping portion is arranged at an end of the upper clamping head or the lower clamping head.

The invention has following beneficial effects: the clamping head is provided with a twisted deflection angle, and a hairstyle with an inclined angle and a twisted shape can be realized without rotation of a user's hand, the hairstyle is layered strongly, a hair perming operation is convenient, and the hairstyle can be completed without major changes to a perm action.

Figure 1:
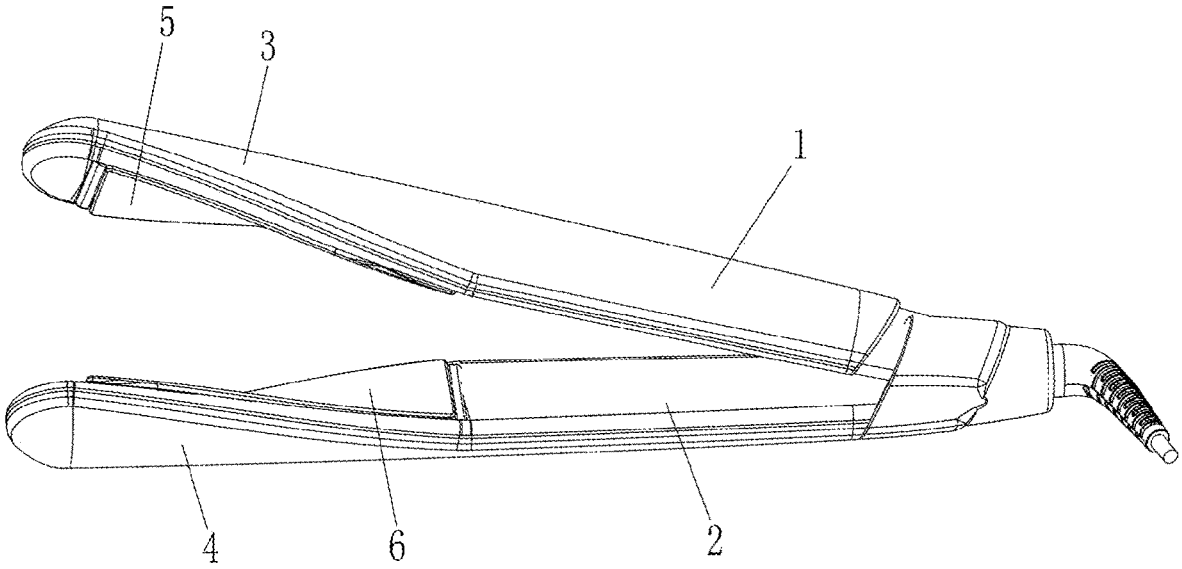
FIG. 1 is a schematic view of an overall structure of an angle deflection type twisted hair styling device according to an embodiment of the invention.

1. Upper gripping portion
2. Lower gripping portion
3. Upper clamping head
4. Lower clamping head
5. Upper clamping surface
6. Lower clamping surface
7. Auxiliary gripping portion
8. Upper side teeth
9. Lower side teeth
10. Upper twisted deflection angle
11. Lower twisted deflection angle

DETAILED DESCRIPTION OF PREFERRED EMBODIMENTS

The invention will be further described in detail below in conjunction with accompanying drawings.

As shown in FIG. 1, an embodiment of the invention provides an angle deflection type twisted hair styling device including an upper gripping portion 1 and a lower gripping portion 2. The upper gripping portion 1 and the lower gripping portion 2 are openable and closable through a hinge structure. An upper clamping head 3 is connected to the upper gripping portion 1, a lower clamping head 4 is connected to the lower gripping portion 2, an upper clamping surface 5 is provided on the upper clamping head 3, a lower clamping surface 6 is provided on the lower clamping head 4, and the upper clamping surface 5 is arranged to be paired with the lower clamping surface 6. The upper clamping surface 5 has an upper twisted deflection angle 10 with respect to the upper gripping portion 1, and the lower clamping surface 6 has a lower twisted deflection angle 11 with respect to the lower gripping portion 2. The upper twisted deflection angle 10 is equal to the lower twisted deflection angle 11, such that a fitting between the upper clamping surface 5 and the lower clamping surface 6 is ensured. Both the upper clamping surface 5 and the lower clamping surface 6 are electrically connected to an electric control device, so as to achieve electric heating. In order to ensure heat generation efficiency, the upper clamping surface 5 is a heating surface of an upper heat generating plate, and the lower clamping surface 6 is a heating surface of a lower heat generating plate. That is, the upper heat generating plate has the upper twisted deflection angle with respect to the upper gripping portion 1, and the lower heat generating plate has the lower twisted deflection angle with respect to the lower gripping portion 2.

Furthermore, the upper clamping head 3 has the upper twisted deflection angle with respect to the upper gripping portion 1, and the lower clamping head 4 has the lower twisted deflection angle with respect to the lower gripping portion 2. Since each of the upper clamping head 3 and the lower clamping head 4 is provided with a corresponding twisted deflection angle, the user's operation is more convenient and labor-saving.

Figure 2:
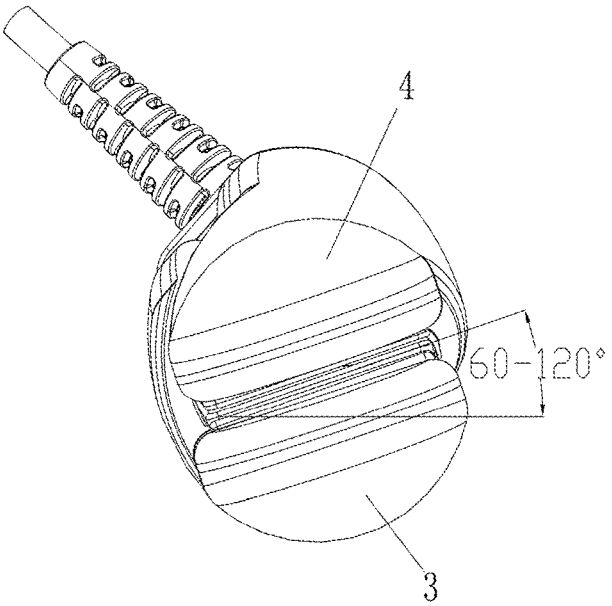
FIG. 2 is a schematic view of a twisted deflection angle of an angle deflection type twisted hair styling device according to an embodiment of the invention.
Figure 3:
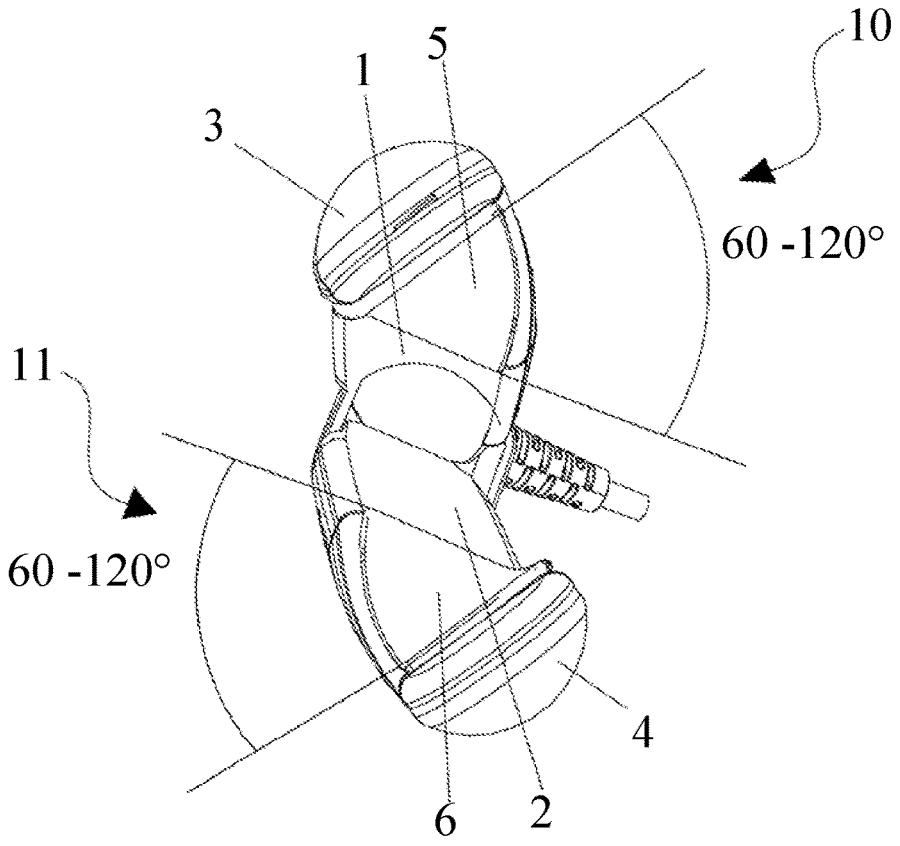
FIG. 3 is another schematic view of a twisted deflection angle of an angle deflection type twisted hair styling device according to an embodiment of the invention.

As shown in FIGS. 2-3, the upper twisted deflection angle and the lower twisted deflection angle each are in a range of 60-120 degrees. The upper and lower twisted deflection angles each use an inner side plane of the corresponding gripping portion and a plane where an end of the corresponding gripping surface (an outer end) as reference bases, and an axis about which each of the upper clamping head and the lower clamping head is twisted is a long axis of the corresponding gripping portion. That is, regarding the upper clamping surface, the upper clamping head and the upper gripping portion, twisted axes therefor are all on a same axis, and in the illustrated embodiment the long axis of the upper gripping portion is used as the same axis. Regarding the lower clamping surface, the lower clamping head and the lower gripping portion, twisted axes therefor are all on a same axis, and in the illustrated embodiment the long axis of the lower gripping portion is used as the same axis.

Furthermore, an upper heat insulating layer is arranged between the upper clamping head 3 and the upper clamping surface 5, and a lower heat insulating layer is arranged between the lower clamping head 4 and the lower clamping surface 6. The upper heat insulation layer and the lower heat insulation layer respectively prevent heat of the heat generating plates from delivering to the upper clamping head 3 and the lower clamping head 4, such that a temperature difference is formed between the upper clamping head 3 and the upper clamping surface 5, and also formed between the lower clamping head 4 and the lower clamping surface 5. The upper heat insulation layer and lower heat insulation layer may be made of a cold gel or heat insulation foam.

Figure 4:
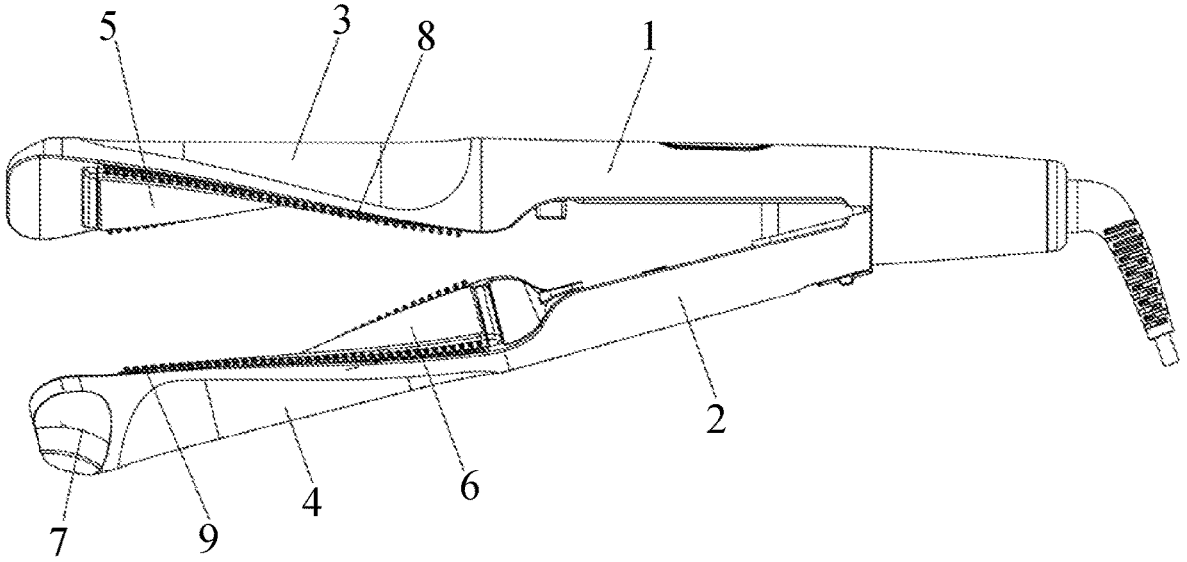
FIG. 4 is a schematic structural view of another angle deflection type twisted hair styling device according to an embodiment of the invention.

As shown in FIG. 4, in another embodiment, an outer edge of the upper clamping surface 5 is provided with upper side teeth 8, and an outer edge of the lower clamping surface 6 is provided with lower side teeth 9. When hairs are clamped between the upper clamping surface 5 and the lower clamping surface 6, the upper side teeth 8 and the lower side teeth 9 may be engaged/meshed with each other or may not be engaged with each other, and can be used to comb hairs. Furthermore, the upper side teeth 8 and the lower side teeth 9 can be provided in one turn, two turns, and the like.

An auxiliary gripping portion 7 is provided at an end of the upper clamping head 3 or an end of the lower clamping head 4. When the angle deflection type twisted hair styling device of the invention is used, the upper gripping portion 1 or the lower gripping portion 2 is gripped by one hand, and the other hand assists in gripping the auxiliary gripping portion 7, thereby enhancing gripping effect of hairs.

A working principle of the angle deflection type twisted hair styling device of the invention is as follows: holding the upper gripping portion 1 and the lower gripping portion 2 by hand, opening the upper clamping head 3 and the lower clamping head 4 so as to put hairs in a clamping region defined between the upper clamping surface 5 and the lower clamping surface 6, and starting a power supply of the hair styling device (can be also pre-activated), the upper clamping surface 5 and the lower clamping surface 6 will be heated, the upper clamping surface 5 and the lower clamping surface 6 then are closed, a hairstyle with a twisted shape can be completed by using the hair styling device to pull hairs straightly.

The above embodiments are merely intended to be illustrative and not limited to the invention, and equivalents and modifications of the methods described in the scope of the invention are included in the protection scope of the invention.

What is claimed is:

1. An angle deflection type twisted hair styling device, comprising:

an upper gripping portion and a lower gripping portion, the upper gripping portion and the lower gripping portion are openable and closeable through a hinge structure; wherein an upper clamping head is connected to the upper gripping portion, a lower clamping head is connected to the lower gripping portion, an upper clamping surface is provided on the upper clamping head, a lower clamping surface is provided on the lower clamping head, and the upper clamping surface is arranged to be paired with the lower clamping surface; the upper clamping surface has an upper twisted deflection angle with respect to the upper gripping portion, and the lower clamping surface has a lower twisted deflection angle with respect to the lower gripping portion, the upper twisted deflection angle is equal to the lower twisted deflection angle, wherein a top of the upper clamping head and a bottom of the lower clamping head collectively define an outer surface of the hair styling device, and wherein the outer surface is curved to form a cylinder extending around an axis and from the upper and lower gripping portions to ends of the upper and lower clamping heads when the hair styling device is in a closed position;

an upper heat insulation layer between the upper clamping surface and the top of the upper clamping head; and a lower heat insulation layer between the lower clamping surface and the bottom of the lower clamping head;

wherein the upper twisted deflection angle is an intersection angle between an inner side plane of the upper gripping portion and a plane where an end of the upper clamping surface facing away from the inner side plane of the upper gripping portion is located, the lower twisted deflection angle is an intersection angle between an inner side plane of the lower gripping portion and a plane where an end of the lower clamping surface facing away from the inner side plane of the lower gripping portion is located, and the upper twisted deflection angle and the lower twisted deflection angle each are in a range of 60-120 degrees.

2. An angle deflection type twisted hair styling device, comprising: an upper gripping portion and a lower gripping portion, the upper gripping portion and the lower gripping portion are openable and closeable through a hinge structure; wherein an upper clamping head is connected to the upper gripping portion, a lower clamping head is connected to the lower gripping portion, an upper clamping surface is provided on the upper clamping head, a lower clamping surface is provided on the lower clamping head, and the upper clamping surface is arranged to be paired with the lower clamping surface; the upper clamping surface has an upper twisted deflection angle with respect to the upper gripping portion, and the lower clamping surface has a lower twisted deflection angle with respect to the lower gripping portion, the upper twisted deflection angle is equal to the lower twisted deflection angle, wherein a top of the upper clamping head and a bottom of the lower clamping head collectively define an outer surface of the hair styling device, and wherein the outer surface is curved to form a cylinder extending around an axis and from the upper and lower gripping portions to ends of the upper and lower clamping heads when the hair styling device is in a closed position;

wherein the angle deflection type twisted hair styling device further comprises an upper heat generating plate and a lower heat generating plate, an upper heat insulation layer is provided between the top of the upper clamping head and the upper clamping surface, and a lower heat insulation layer is provided between the bottom of the lower clamping head and the lower clamping surface, the upper heat insulation layer prevents heat of the upper heat generating plate from delivering to the top of the upper clamping head and the lower heat insulation layer prevents heat of the lower heat generating plate from delivering to the bottom of the lower clamping head, such that a temperature difference is formed between the top of the upper clamping head and the upper clamping surface, and also formed between the bottom of the lower clamping head and the lower clamping surface; and the upper heat insulation layer and the lower heat insulation layer are made of a cold gel or a heat insulation foam.

3. An angle deflection type twisted hair styling device, comprising: an upper gripping portion and a lower gripping portion, the upper gripping portion and the lower gripping portion are openable and closeable through a hinge structure; wherein an upper clamping head is connected to the upper gripping portion and has a free end away from the upper gripping portion, a lower clamping head is connected to the lower gripping portion and has a free end away from the lower gripping portion, an upper clamping surface is provided on the upper clamping head, a lower clamping surface is provided on the lower clamping head, and the upper clamping surface is arranged to be paired with the lower clamping surface; the upper clamping surface has an upper twisted deflection angle with respect to the upper gripping portion, and the lower clamping surface has a lower twisted deflection angle with respect to the lower gripping portion, the upper twisted deflection angle is equal to the lower twisted deflection angle, wherein a top of the upper clamping head and a bottom of the lower clamping head collectively define an outer surface of the hair styling device, and wherein the outer surface is curved to form a cylinder extending around an axis and from the upper and lower gripping portions to ends of the upper and lower clamping heads when the hair styling device is in a closed position;

an upper heat insulation layer between the upper clamping surface and the top of the upper clamping head; and a lower heat insulation layer between the lower clamping surface and the bottom of the lower clamping head;

wherein the upper twisted deflection angle is an intersection angle between an inner side plane of the upper gripping portion and a plane where the upper clamping surface at the free end of the upper clamping head is located, the lower twisted deflection angle is an intersection angle between an inner side plane of the lower gripping portion and a plane where the lower clamping surface at the free end of the lower clamping head is located, and the upper twisted deflection angle and the lower twisted deflection angle each are in a range of 60-120 degrees; and wherein the upper clamping head is twisted with respect to the upper gripping portion and a twisted degree of the upper clamping head is no more than the upper twisted deflection angle, the lower clamping head is twisted with respect to the lower gripping portion and a twisted degree of the lower clamping head is no more than the lower twisted deflection angle.

4. A hair styler comprising:

an upper arm including an upper grip and an upper clamp head, the upper clamp head including a top and an upper clamp plate including an upper hair contact surface, wherein the upper clamp plate and the upper hair contact surface are twisted relative to the upper grip;

an upper heat insulation layer between the upper clamp plate and the top of the upper clamping head;

a lower arm including a lower grip and a lower clamp head, the lower clamp head including a bottom and a lower clamp plate including a lower hair contact surface, wherein the lower clamp plate and the lower hair contact surface are twisted relative to the lower grip;

a lower heat insulation layer between the lower clamp plate and the bottom of the lower clamping head; and a hinge attaching the upper and lower arms together such that the upper and lower arms are openable and closeable relative to one another, wherein the hair styler is configured to receive hair between the upper and lower hair contact surfaces when the hair styler is in a closed position, wherein the top of the upper clamping head and the bottom of the lower clamping head collectively define an outer surface of the hair styler, and wherein the outer surface is curved to form a cylinder extending around an axis and from the upper and lower gripping portions to ends of the upper and lower clamping heads when the hair styler is in the closed position.

5. The angle deflection type twisted hair styling device according to claim 1, wherein the angle deflection type twisted hair styling device further comprises an upper heat generating plate and a lower heat generating plate;

wherein the upper heat insulation layer prevents heat of the upper heat generating plate from delivering to the top of the upper clamping head and the lower heat insulation layer prevents heat of the lower heat generating plate from delivering to the bottom of the lower clamping head, such that a temperature difference is formed between the top of the upper clamping head and the upper clamping surface, and also formed between the bottom of the lower clamping head and the lower clamping surface; and the upper heat insulation layer and the lower heat insulation layer are made of a cold gel or a heat insulation foam.

6. The angle deflection type twisted hair styling device according to claim 1, wherein upper side teeth are arranged at an outer edge of the upper clamping surface, and lower side teeth are arranged at an outer edge of the lower clamping surface.

7. The angle deflection type twisted hair styling device according to claim 1, wherein an auxiliary gripping portion is arranged at an end of the upper clamping head facing away from the upper gripping portion or at an end of the lower clamping head facing away from the lower gripping portion.

8. The angle deflection type twisted hair styling device according to claim 1, wherein an axis about which the upper clamping head is twisted is a long axis of the upper gripping portion, and an axis about which the lower clamping head is twisted is a long axis of the lower gripping portion.

9. The angle deflection type twisted hair styling device according to claim 1, wherein twisted axes of the upper clamping surface, the upper clamping head and the upper gripping portion are all on a long axis of the upper gripping portion, and twisted axes of the lower clamping surface, the lower clamping head and the lower gripping portion are all on a long axis of the lower gripping portion.

10. The angle deflection type twisted hair styling device according to claim 5, wherein the upper heat generating plate has the upper twisted deflection angle with respect to the upper gripping portion, and the lower heat generating plate has the lower twisted deflection angle with respect to the lower gripping portion.

11. The angle deflection type twisted hair styling device according to claim 5, wherein the upper clamping surface is a heating surface of the upper heat generating plate, the lower clamping surface is a heating surface of the lower heat generating plate.

12. The hair styler of claim 4, wherein the upper hair contact surface has a first twist angle and the lower hair contact surface has a second twist angle, wherein the first twist angle is equal to the second twist angle such that the upper and lower hair contact surfaces fit together when the hair styler is in the closed position.

13. The hair styler of claim 4, wherein the upper hair contact surface has a first twist angle and the lower hair contact surface has a second twist angle, wherein the first twist angle and the second twist angle each are in a range of 60 degrees to 120 degrees.

14. The hair styler of claim 4 further comprising a heating system configured to deliver heat to hair positioned between the upper hair contact surface and the lower hair contact surface.

15. The hair styler of claim 4 further comprising first teeth along an edge of the upper hair contact surface and second teeth along an edge of the lower hair contact surface, wherein the first teeth and the second teeth are arranged to engage each other when the hair styler is in the closed position.

16. The hair styler of claim 4, wherein the upper and lower hair contact surfaces are smooth and free of any teeth.

17. The hair styler of claim 4 further comprising an upper end grip at an end of at least one of the upper arm and the lower arm opposite the upper and lower grips.

* * * * *